US007850385B2

(12) United States Patent
Noguchi

(10) Patent No.: US 7,850,385 B2
(45) Date of Patent: Dec. 14, 2010

(54) LIQUID SUPPLY IMPLEMENT

(75) Inventor: Yoshio Noguchi, Saitama (JP)

(73) Assignee: Kotobuki & Co., Ltd., Saitama (JP)

( * ) Notice: Subject to any disclaimer, the term of this patent is extended or adjusted under 35 U.S.C. 154(b) by 909 days.

(21) Appl. No.: 11/736,795

(22) Filed: Apr. 18, 2007

(65) Prior Publication Data

US 2007/0248401 A1 Oct. 25, 2007

(30) Foreign Application Priority Data

Apr. 21, 2006 (JP) ..... 2006-117534

(51) Int. Cl.
*B43K 5/00* (2006.01)

(52) U.S. Cl. ..... 401/198; 401/45; 401/46

(58) Field of Classification Search ..... 401/44–47, 401/198, 199, 223–225
See application file for complete search history.

(56) References Cited

U.S. PATENT DOCUMENTS 1,042,726 A * 10/1912 Tolles ..... 401/45
1,797,465 A * 3/1931 De Biasi ..... 401/45
2,130,978 A * 9/1938 White ..... 401/45
2,642,042 A * 6/1953 Pinkney ..... 401/45

FOREIGN PATENT DOCUMENTS

JP 5-2989 1/1993
JP 11-512668 4/1997

* cited by examiner

*Primary Examiner*—David J Walczak
(74) *Attorney, Agent, or Firm*—Miller, Matthias & Hull

(57) ABSTRACT

A liquid supply implement can accommodate a large amount of liquid without being subjected to limitation of a capacity of a temporary storage chamber temporarily storing the liquid overflowing a tank, or can reduce the capacity of the temporary storage chamber. A tank formed inside a rear barrel and accommodating a liquid is divided into a plurality of tank portions. In order that all the tank portions do not communicate with a tip end supply element between the tank and a pen tip, any one of a plurality of through-holes of an inner plug respectively communicating with the respective tank portions is allowed to communicate with one through-hole formed in a lateral wall of a front barrel. By rotating the rear barrel with respect to the front barrel, selected tank portion can be switched.

5 Claims, 8 Drawing Sheets

18d
18
18a
18b
14
18b
20d
20b
20b
20
20a
20a
16b
16a
24
16
22
22a
26
28

18a
14
20
16b
16a
24
16
22
22a
26
28

18d
18
18a
18b
14
18b
20d
20b
20b
20
20a
16b
16a
24
16
22
22a
26
28

LIQUID SUPPLY IMPLEMENT

BACKGROUND OF THE INVENTION

1. Field of the Invention

The present invention relates to a liquid supply implement having a tank which accommodates a liquid, and supplying the liquid from a tip end supply element.

2. Description of the Related Art

Conventional liquid supply implements have a problem that a leakage of an accommodated liquid occurs when an internal air in the liquid supply implements is expanded due to variation of an atmospheric pressure difference between the external air and the internal air pressure etc. and the liquid drops from the liquid supply part at a tip end portion of the liquid supply implement.

A lot of known liquid supply implements including liquid reservoir parts have been proposed in order to prevent such a problem (for example, Japanese Utility Model Laid-Open No. 5-2989 (FIGS. 1 to 4), Japanese Patent Publication of International Patent Application Laid-Open No. 11-512668). The liquid reservoir part comprises a temporary storage chamber constituted of annular grooves formed into a so-called bellows shape, and the temporary storage chamber is provided outward in an outer diameter direction of a guide part connecting the tank and the tip end supply element so as to be separated from the guide part. The liquid reservoir part has a liquid flow port communicating with the tank at a rear end portion of the liquid reservoir part and an air flow port communicating with an outside at a tip end portion of the liquid reservoir part.

The liquid overflowing the tank due to rise in the internal air pressure passes through the liquid flow port by a capillary force and accumulates in the temporary storage chamber constituted of the bellows-shaped grooves, and when the air pressure returns to an original level, the liquid returns into the tank from the temporary storage chamber through the liquid flow port.

However, even in such a liquid supply implement, if a liquid whose amount exceeds the storage capacity of the temporary storage chamber overflows the tank, the extra liquid leaks to the outside. Therefore, there arises a problem that the size of the tank and the liquid storage amount are limited by the capacity of the temporary storage chamber, and the liquid supply implement cannot accommodate a large amount of liquid by being subjected to the limitation of the capacity of the temporary storage chamber.

SUMMARY OF THE INVENTION

The present invention is made in view of the above problem, and has an object to provide a liquid supply implement capable of storing a large amount of liquid without being subjected to limitation of the capacity of a temporary storage chamber, or capable of reducing the capacity of the temporary storage chamber.

In order to attain the above-described object, a liquid supply implement according to the present invention includes a tank accommodating a liquid, a tip end supply element which is located at a tip end side and supplies the liquid to an outside, and a temporary storage chamber which temporarily stores the liquid overflowing the tank in order to prevent leakage of the liquid to the outside from the tip end supply element.

The aforesaid tank is divided into a plurality of tank portions, and a selection mechanism which selectively allows the tank portions to communicate with the tip end supply element so as not to allow all the tank portions to communicate with the tip end supply element at the same time is provided between the aforesaid tank and the tip end supply element.

According to the present invention, since the tank is divided into a plurality of tank portions, and all the tank portions are prevented from communicating with the tip end supply element at the same time, the storage amount of the temporary storage chamber is made only one corresponding to the total amount of the tank portion(s) which is capable of communicating with the temporary storage chamber at the same time, and limitation of the capacity of the temporary storage chamber is relaxed. Thereby, a large amount of liquid can be accommodated in all the tank portions. Alternatively, the temporary storage chamber can be made small.

The aforesaid selection mechanism can include a plurality of first openings which are formed in a first member and communicate with the respective tank portions, and a second opening which is formed in a second member, can be aligned with any one of the aforesaid plurality of first openings, and communicates with the tip end supply element.

Selection of the tank portion by the selection mechanism can be switched by relative rotation between the aforesaid first member and second member.

The liquid supply implement can include a rear barrel which has the aforesaid tank inside, and a front barrel which holds the tip end supply element, and selection of the tank portion by the aforesaid selection mechanism is switched by relative rotation between the rear barrel and the front barrel.

The liquid supply implement can include a front barrel which holds the aforesaid tip end supply element, a cartridge which has a tank inside and is attachable and detachable to and from the front barrel, and selection of the tank portion by the aforesaid selection mechanism is switched by relative rotation between at least a part of the cartridge and the front barrel.

The present disclosure relates to subject manner contained in Japanese Patent Application No. 2006-117534, filed on Apr. 21, 2006, which is expressly incorporated herein by reference in its entirety.

DETAILED DESCRIPTION OF THE PREFERRED EMBODIMENTS

Hereinafter, embodiments of the present invention will be described by using the drawings.

First Embodiment

Figure 1:
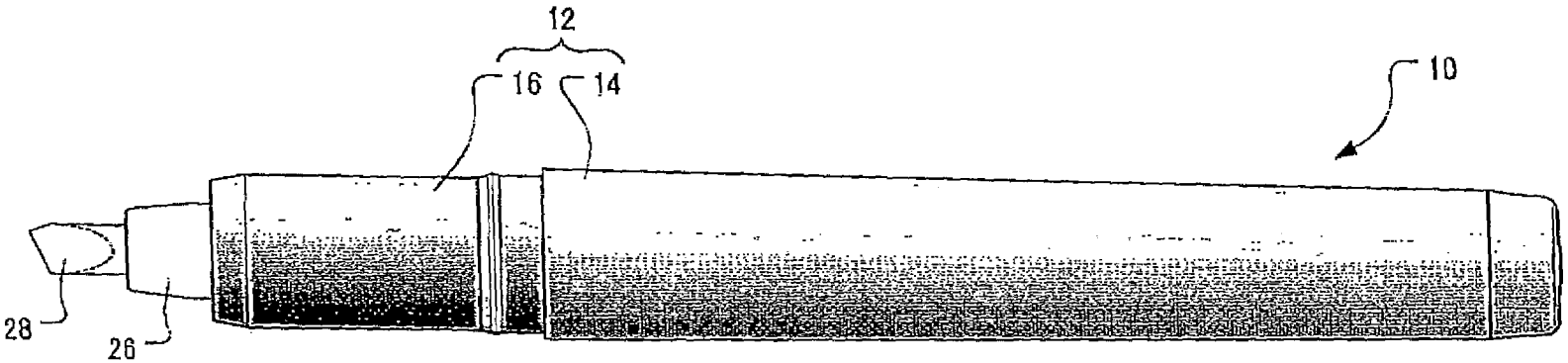
FIG. 1 is an entire view showing a first embodiment of a liquid supply implement according to the present invention.
Figure 2:
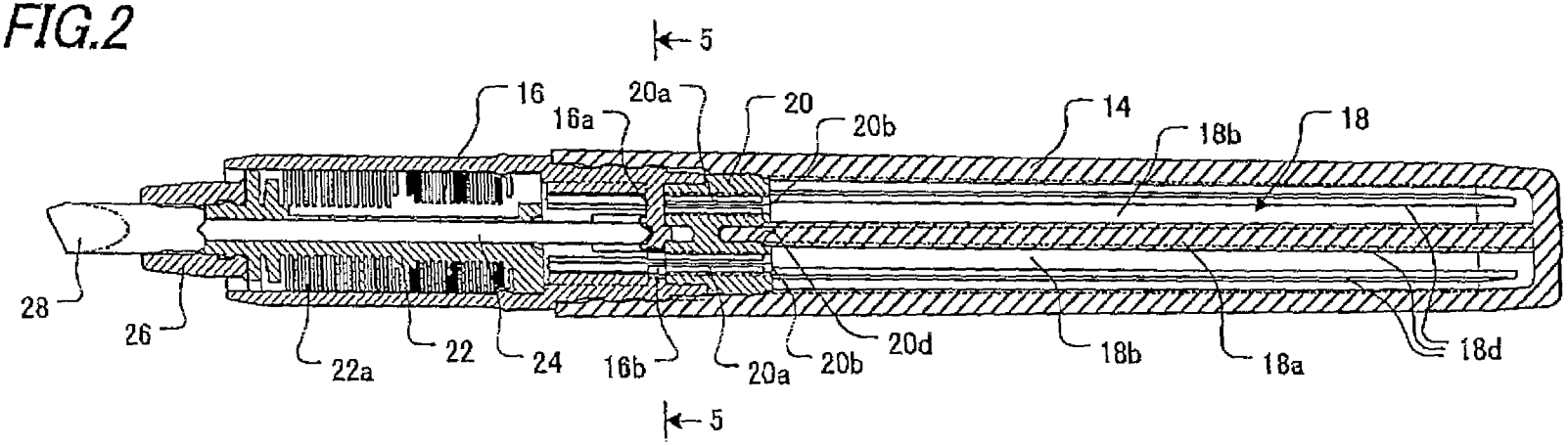
FIG. 2 is a longitudinal sectional view of the liquid supply implement in FIG. 1.

FIG. 1 is an entire view showing a first embodiment of a liquid supply implement according to the present invention, and FIG. 2 is a longitudinal sectional view thereof. An outer barrel 12 of the liquid supply implement 10 is constituted of a rear barrel 14 forming therein a tank 18 accommodating a liquid, and a front barrel 16 to which the rear barrel 14 is rotatably connected. The rear barrel 14 is in a cylindrical shape and one end of the real barrel 14 is closed.

Figure 3:
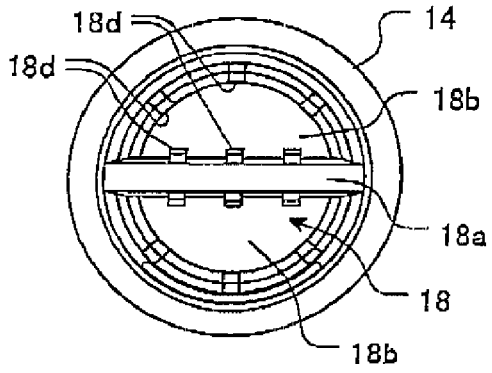
FIG. 3 is an end view seen from the front of a rear barrel.

As shown in FIG. 2, a partition wall 18*a* extending in an axial direction is provided in the tank 18. In this embodiment, the partition wall 18*a* is formed integrally with the rear barrel 14 so as to extend forward from a rear end surface of an inner surface of the rear barrel 14. The tank 18 is divided into two tank portions 18*b* and 18*b* each in a substantially semicircular shape in section by the partition wall 18*a* as shown in FIG. 3, and a liquid for stationery, a paint material, cosmetic, medicine or the like is filled in each of the tank portions 18*b*. A plurality of ribs 18*d* are properly formed on an inner peripheral surface of each of the tank portions 18*b* and a wall surface of the partition wall 18*a* to make a flow of the liquid smooth by utilizing a capillary force. Instead of the ribs, streak-shaped knurls and grooves can be utilized.

Figure 4B:
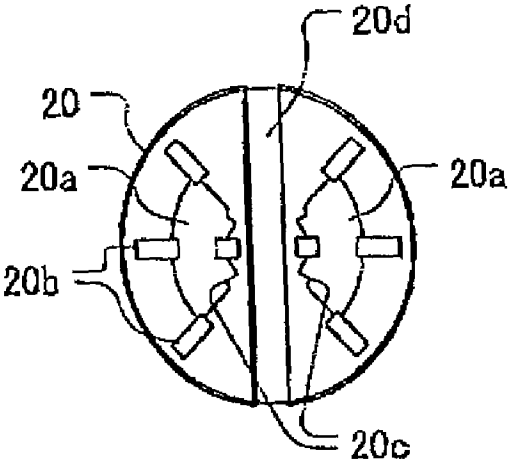
FIG. 4B is an end view of the inner plug seen from the rear.
Figure 4A:
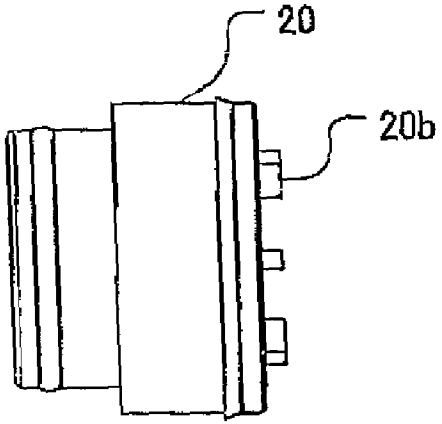
FIG. 4A is a side view of an inner plug.
Figure 4C:
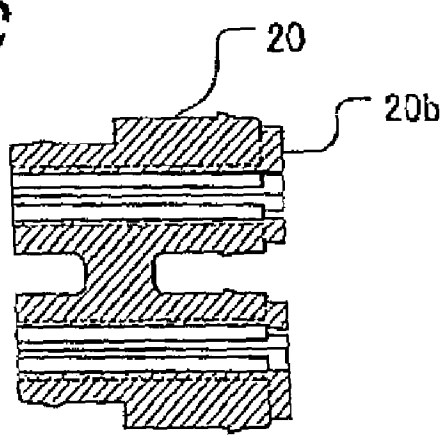
FIG. 4C is a longitudinal sectional view of the inner plug.

An inner plug 20 is placed between the rear barrel 14 and the front barrel 16. A groove 20*d* extending in a diameter direction in which the front end of the partition wall 18*a* is fitted is formed in a rear surface of the inner plug 20. Two through-holes 20*a* and 20*a* penetrating through the inner plug 20 in the axial direction are formed to be spaced at 180 degrees in the inner plug 20, and each of the through-holes 20*a* communicates with the corresponding tank portion 18*b*. As shown in FIG. 4, a plurality of ribs 20*b* are formed on the rear end surface of the inner plug 20, and a plurality of ribs 20*c* are formed on an inner peripheral surface of the through-hole 20*a* to make a flow of the liquid smooth by using a capillary force. The inner plug 20 rotates integrally with the rear barrel 14.

Figure 5:
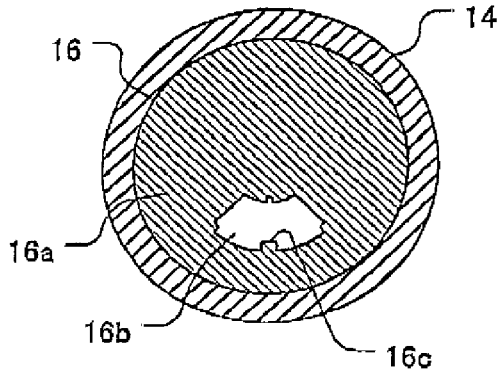
FIG. 5 is a sectional view seen along the line 5-5 in FIG. 2.

A lateral wall 16*a* orthogonal to the axial direction is formed at a rear end portion of the front barrel 16, and the inner plug 20 abuts against the lateral wall 16*a*. One through-hole 16*b* is formed in the lateral wall 16*a*. The through-hole 16*b* is formed at a position offset from a center to communicate with any of the through-holes 20*a*, and is set to have such a size that it does not communicate with all the through-holes 20*a* at the same time, as shown in FIG. 5. A plurality of ribs 16*c* are formed on an inner peripheral surface of the through-hole 16*b* to make a flow of the liquid smooth.

The sectional shapes of the through-hole 20*a* and the through-hole 16*b* can have an optional shape other than the sector shape shown in the drawings. In this embodiment, the through-holes 20*a* and 16*b* constitute a selection mechanism.

An adjuster 22 having a temporary storage chamber 22*a* which stores a liquid overflowing the tank and is constituted of the bellows-shaped grooves, a joint core 24 penetrating through the adjuster 22, and a tip tool 26 mounted to a front end of the joint core 24 are accommodated in the front barrel 16. A pen tip 28 which is a tip end supply element supplying a liquid to a desired place at the time of use is press-fitted in the tip tool 26 so that the pen tip 28 is held by the front barrel 16. The pen tip which is the liquid supply element of the present invention is not limited to the one in the form shown in the drawings, and an optional pen tip such as a fountain pen tip, a roller ball point pen tip, a brush tip, a brush and a plastic pen core can be used. The pen tip 28 can be protected by a cap not shown when it is not in use.

When the liquid supply implement 10 constituted as above is used, the cap not shown is removed first, and the liquid is coated onto a required place by using the pen tip 28. At this time, the through-hole 16*b* of the front barrel 16 communicates with one of the through-holes 20*a* of the inner plug 20. Therefore, the liquid from one of the tank portions 18*b* passes through the through-hole 20*a* and the through-hole 16*b*, and further passes through the joint core 24 to be supplied to an object to which the liquid is supplied, from the pen tip 28.

In this selection state, since only one of the tank portions 18*b* communicates with the pen tip 28, even if air expansion of the tank portion 18*b* occurs and the liquid overflows the tank portion 18*b*, the maximum liquid amount to be stored in the temporary storage chamber 22*a* of the adjuster 22 is only a half of the capacity of the entire tank 18 at most. Therefore, the limitation of the capacity of the adjuster 22 is relaxed to make it possible to store the liquid without being subjected to the limitation.

When the liquid in one of the tank portions 18*b* is consumed, the rear barrel 14 is rotated 180 degrees with respect to the front barrel 16 as shown in FIG. 6, and the inner plug 20 is rotated together with the rear barrel 14. Then, the through-hole 16*b* of the front barrel 16 is caused to communicate with the other through-hole 20*a* of the inner plug 20. Thereby, the other tank portion 18*b* and the through-hole 16*b* communicate with each other, the liquid from the other tank portion 18*b* passes through the through-hole 20*a* and the through-hole 16*b*, and further passes through the joint core 24 to be supplied to the object to which the liquid is supplied, from the pen tip 28.

In this selection state, only the other tank portion 18*b* communicates with the pen tip 28, and therefore, the limitation of the capacity of the temporary storage chamber 22*a* of the adjuster 22 is relaxed to make it possible to store the liquid without being subjected to the limitation.

The through-hole 16*b* does not communicate with the two through-holes 20*a* at the same time, and therefore, the tank 18 is not likely subjected to the limitation of the capacity of the temporary storage chamber 22*a* of the adjuster 22. As a result, the adjuster 22 can be made compact, or the tank 18 can be made large.

Figures 6A, 6B, 6C:
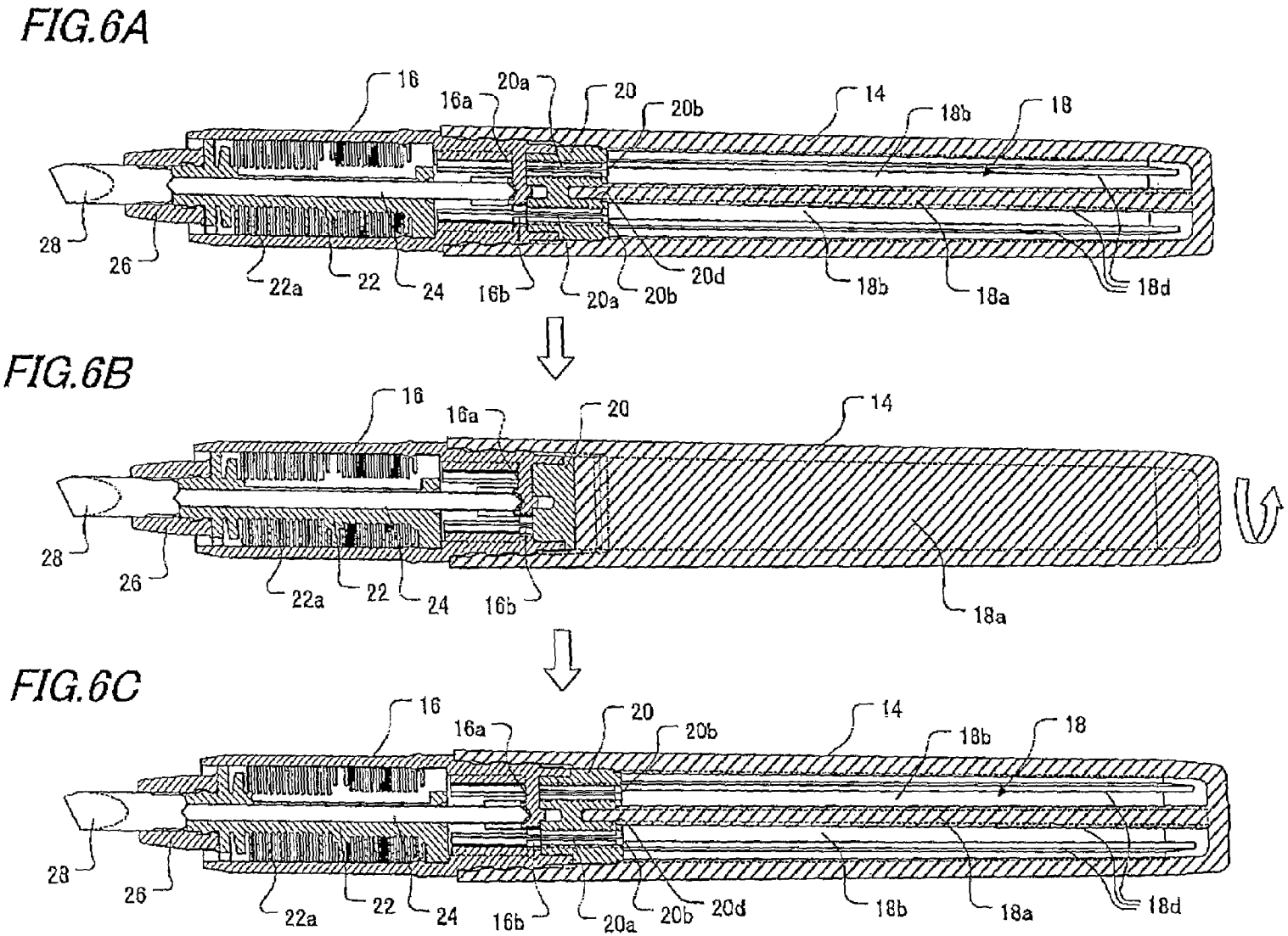
FIGS. 6A-6C are views showing an operation procedure of the first embodiment.

Optionally, the rear barrel 14 may be rotated with respect to the front barrel 16 together with the inner plug 20 when the use is finished, so that the through-hole 16*b* comes between the two through-holes 20*a* of the inner plug 20. In this manner, as shown in FIG. 6B, the through-hole 16*b* is closed by the inner plug 20 and liquid leakage can be completely prevented when not in use.

Second Embodiment

Figure 7:
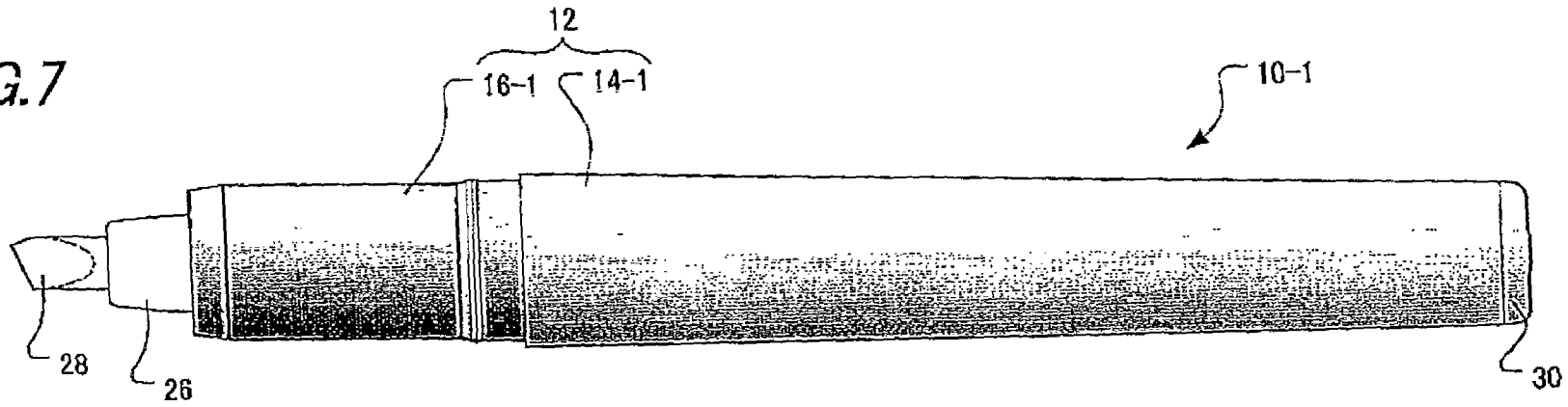
FIG. 7 is an entire view showing a second embodiment of the liquid supply implement according to the present invention.
Figure 8:
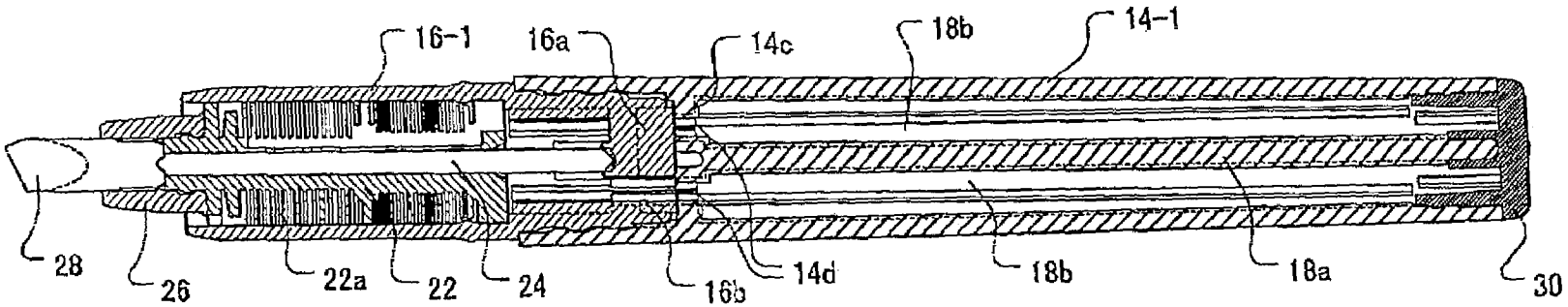
FIG. 8 is a longitudinal sectional view of the liquid supply implement of FIG. 7.

FIG. 7 is an entire view showing a second embodiment of the liquid supply implement according to the present invention, and FIG. 8 is a longitudinal sectional view thereof. In this embodiment, the same/similar members/parts as/to the first embodiment are assigned with the same reference numerals and characters, and explanation of them will be omitted.

While a liquid supply implement 10-1 of this embodiment comprises the outer barrel 12 constituted of a front barrel 16-1 holding the pen tip 28 and a rear barrel 14-1, the inner plug 20 is omitted. A rear end of the rear barrel 14-1 is opened instead, and the rear end of the rear barrel 14-1 is closed by a tail plug 30. A lateral wall 14*c* which is combined with the partition wall 18*a* and is orthogonal to the axial direction is integrally formed at a front end portion of the rear barrel 14-1. Through-holes 14*d* and 14*d* are formed in the lateral wall 14*c* in correspondence to the respective tank portions 18*b*.

In this embodiment, the through-holes 16*b* and 14*d* constitute a selection mechanism.

Since in this embodiment, the through-hole 16*b* can communicate with only one of the through-holes 14*d*, all the tank portions 18*b* and 18*b* do not communicate with the pen tip 28 at the same time, and therefore, the tank 18 is not likely subjected to the limitation of the capacity of the temporary storage chamber 22*a* of the adjuster 22. As a result, the adjuster 22 can be made compact, or the tank 18 can be made large.

Third Embodiment

Figure 9:
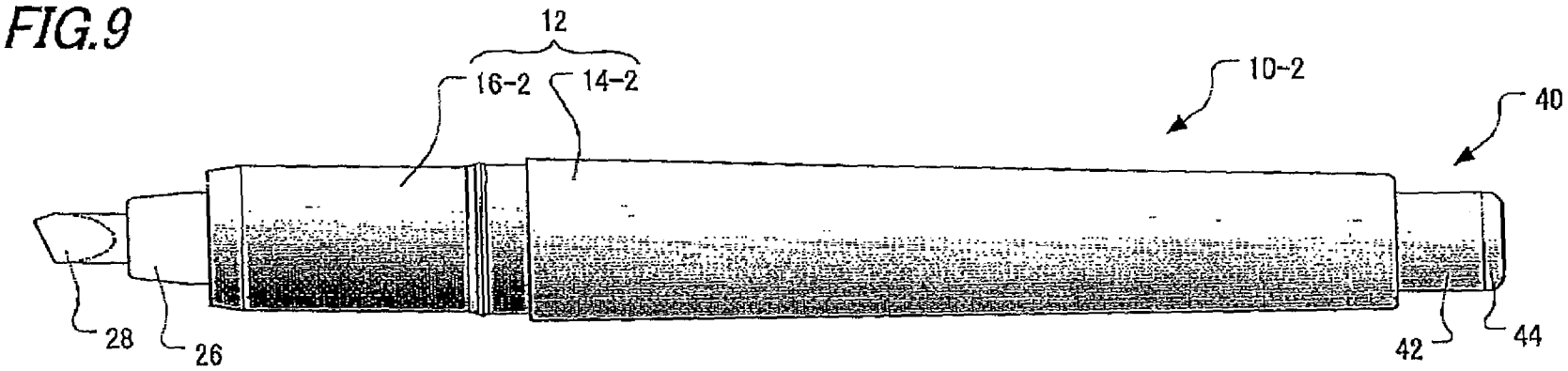
FIG. 9 is an entire view showing a third embodiment of the liquid supply implement according to the present invention.
Figure 10:
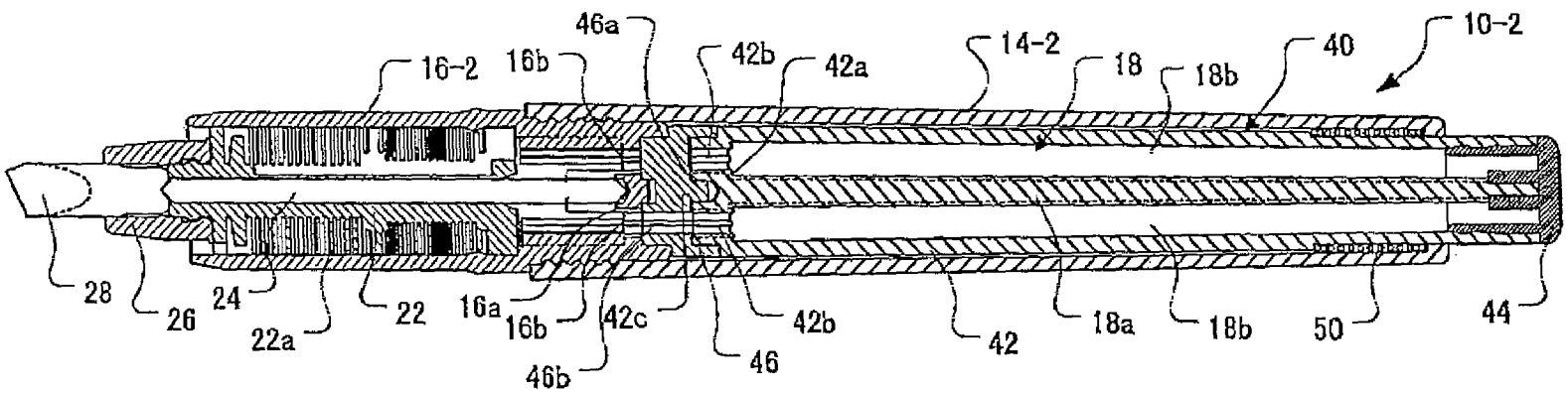
FIG. 10 is a longitudinal sectional view of the liquid supply implement of FIG. 9.
Figure 11:
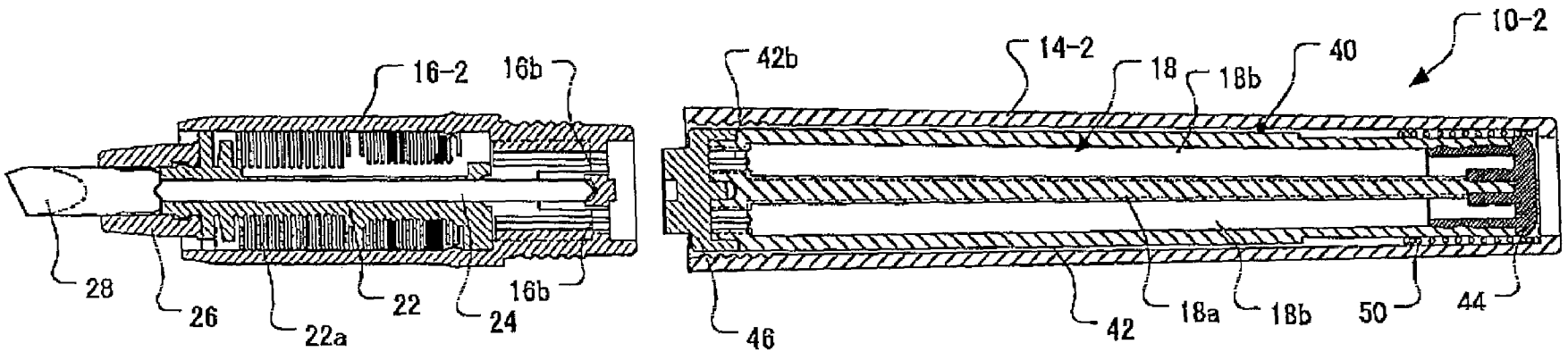
FIG. 11 is a longitudinal sectional view showing an in-progress operation at the time of mounting a cartridge.

FIG. 9 is an entire view showing a third embodiment of the liquid supply implement according to the present invention, and FIG. 10 is a longitudinal sectional view thereof. In this embodiment, the same/similar members/parts as/to the previous embodiments are assigned with the same reference numerals and characters, and explanation of them will be omitted.

A liquid supply implement 10-2 of this embodiment comprises the outer barrel 12 constituted of a front barrel 16-2 holding the pen tip 28 and a rear barrel 14-2, and a cartridge 40 which is attachable to and detachable from the front barrel 16-2 and has the tank 18 inside. The front barrel 16-2 and the rear barrel 14-2 are threadedly fitted to each other. The cartridge 40 is attachable and detachable to and from the front barrel 16-2 in the state in which the front barrel 16-2 and the rear barrel 14-2 are separated by releasing the threadedly fitting of them. The cartridge 40 is attached to the front barrel 16-2, and the rear barrel 14-2 is threadedly fitted to the front barrel 16-2, whereby the cartridge 40 is set in the outer barrel 12. A resilient member 50 provided in the rear barrel 14-2 biases the cartridge 40 forward, and thereby, the cartridge 40 is fixed inside the rear barrel 14-2.

The lateral wall 15*a* is formed at the rear end portion of the front barrel 16-2, and two through-holes 16*b* are formed in the lateral wall 16*a*.

Figure 12:
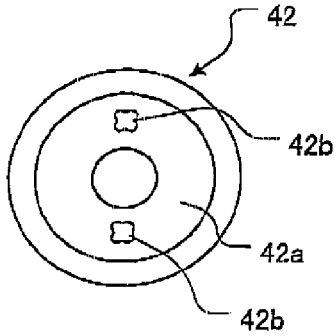
FIG. 12 is an end view of the barrel member of the cartridge seen from the front.

The cartridge 40 comprises a barrel member 42, a tail plug 44 closing a rear end of the barrel member 42, and a tip plug 46 rotatably fitted to a front end of the barrel member 42, and the tank 18 is formed inside the cartridge 40. The partition wall 18*a* extending in the axial direction is integrally formed in the inside of the barrel member 42, and the tank 18 is divided into a plurality of tank portions 18*b* and 18*b* by the partition wall 18*a*. Further, the partition wall 18*a* is integrally connected to a lateral wall 42*a* which is at the front portion of the barrel member 42 and orthogonal to the axial direction. Through-holes 42*b* and 42*b* communicating with the respective tank portions 18*b* are formed in the lateral wall 42*a* as shown in FIG. 12.

Figure 13:
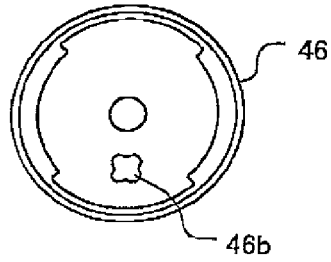
FIG. 13 is an end view of the tip plug of the cartridge seen from the front.
Figure 14:
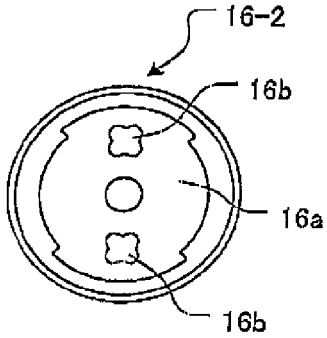
FIG. 14 is an end view of the front barrel seen from the rear.

The tip plug 46 includes a protruded portion 46*a* fitted into a recessed portion 42*c* formed in the lateral wall 42*a* of the barrel member 42 so that the tip plug 46 is rotatable relatively to the barrel member 42. One through-hole 46*b* is formed in the tip plug 46. The through-hole 46*b* is formed at a position offset from the center in order to communicate with any one of the through-holes 42*b*, and is set to have such a size that it does not communicate with all the through-holes 42*b* at the same time, as shown in FIG. 13. The sectional shape of the front end side of the tip plug 46 is the shape which is non-circular and corresponds to the sectional shape of the rear end side of the front barrel 16-2 shown in FIG. 14. The front end side of the tip plug 46 is fitted into the rear end of the front barrel 16-2, and thereby, the tip plug 46 and the front barrel 16-2 are connected to be relatively unrotatable. In this connection state, the through-hole 46*b* is aligned with any one of the through-holes 16*b* and 16*b*.

The rear portion of the barrel member 42 and the tail plug 44 protrude from the rear end of the rear barrel 14-2.

In this embodiment, the through-holes 46*b* and 42*b* constitute a selection mechanism.

In the liquid supply implement 10-2 constituted as above, in the state in which the cartridge 40 is not set in the outer barrel 12, the through-hole 46*b* of the tip plug 46 is not aligned with any of the through-holes 42*b* and 42*b*, and is closed by the lateral wall 42*a*. Therefore, the liquid does not leak from the tank 18.

When the cartridge 40 is attached to the front barrel 16-2, the through-hole 46*b* of the tip plug 46 aligns with any one of the through-holes 16*b* and 16*b*. When any one of the through-holes 42*b* is aligned with the through-hole 46*b* by rotating the portion of the cartridge 40 protruded from the rear end of the rear barrel 14-2 with respect to the outer barrel 12 with the cartridge 40 set in the outer barrel 12, only one of the tank portions 18*b* communicates with the pen tip 28, and the same operation and effect as the previous embodiments can be obtained.

Others

Figure 15:
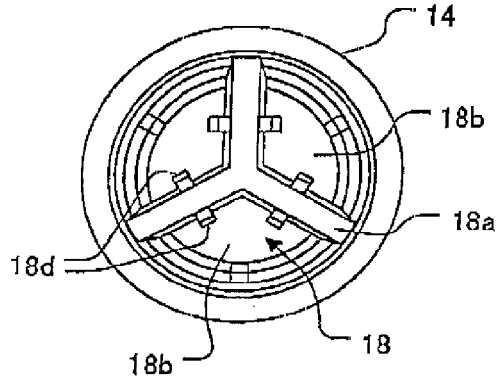
FIG. 15 is an end view of the rear barrel seen from the front in the case of adopting three tank portions.
Figure 16:
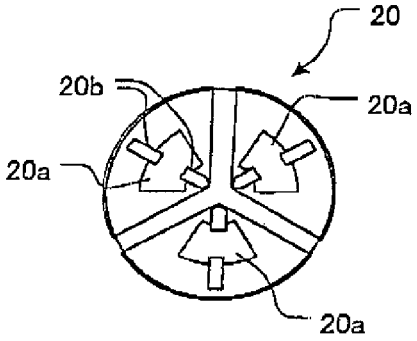
FIG. 16 is an end view of the inner plug seen from the rear in the case of adopting three tank portions.

The above embodiments are the examples in which each of the tanks is divided into the two tank portions, but the present invention is not limited to this. As shown in FIG. 15, the tank can be divided into three tank portions 18*b*, 18*b* and 18*b*, or more by the partition wall 18*a*. In this case, three of the through-holes 20*a* of the inner plug 20 of the first embodiment are formed to be spaced from each other at 120 degrees. The through-hole 16*b* of the front barrel 16 is set so as not to align with the region across the two through-holes 20*a* and 20*a* at the same time.

In the above embodiment, selection of the tank portions is switched by the rotational operation, but the present invention is not limited to this. A knock operation may be converted into rotation of the through-hole by using a known rotational cam mechanism used in a ball-point pen.

In the above embodiments, the same kind of liquid is filled in a plurality of tank portions, and when the liquid in one tank portion is consumed, the tank portion is switched to the next tank portion, but the present invention is not limited to this. Different kinds of liquids can be filled in a plurality of tank portions respectively. For example, when liquids differing in color are filled, use variation can be increased by switching the tank portions in accordance with necessity.

While the principles of the invention have been described above in connection with specific embodiments, and particular modifications thereof, it is to be clearly understood that this description is made only by way of example and not as a limitation on the scope of invention.

What is claimed is:

1. A liquid supply implement comprising:

a tank accommodating a liquid, said tank being divided into a plurality of tank portions;

a tip end supply element which is located at a tip end side for supplying the liquid to an outside;

a temporary storage chamber which temporarily stores the liquid overflowing the tank to prevent leakage of the liquid to the outside from the tip end supply element; and a selection mechanism provided between said tank and the tip end supply element, said selection mechanism selectively allowing the tank portions to communicate with the tip end supply element so as not to allow all the tank portions to communicate with the tip end supply element at the same time; and a joint core which connects the tip end supply element to the selection mechanism, wherein the temporary storage chamber is arranged around the joint core and can store the liquid overflowing from one of the tank portions which communicates with the tip end supply element by means of the selection mechanism.

2. The liquid supply implement according to claim 1, wherein said selection mechanism comprises a plurality of first openings which are formed in a first member and communicate with the respective tank portions, and a second opening which is formed in a second member, can be aligned with any one of said plurality of first openings, and communicates with the tip end supply element.

3. The liquid supply implement according to claim 2, wherein selection of the tank portion by the selection mechanism is switched by relative rotation between said first member and second member.

4. The liquid supply implement according to claim 1, further comprising:

a rear barrel which has said tank inside; and a front barrel which holds the tip end supply element, wherein selection of the tank portion by said selection mechanism is switched by relative rotation between said rear barrel and front barrel.

5. The liquid supply implement according to claim 1, further comprising:

a front barrel which holds said tip end supply element;

a cartridge which has the tank inside and is attachable and detachable to and from the front barrel, wherein selection of the tank portion by said selection mechanism is switched by relative rotation between at least a part of said cartridge and the front barrel.

* * * * *